US008556494B2

(12) United States Patent
Nakano

(10) Patent No.: US 8,556,494 B2
(45) Date of Patent: Oct. 15, 2013

(54) SYSTEM FOR MANUFACTURING EMULSIFIED/DISPERSED LIQUID

(75) Inventor: Mitsuru Nakano, Sakai (JP)

(73) Assignee: Michael Hawes, Pinehurst, NC (US)

( * ) Notice: Subject to any disclaimer, the term of this patent is extended or adjusted under 35 U.S.C. 154(b) by 0 days.

(21) Appl. No.: 13/417,732

(22) Filed: Mar. 12, 2012

(65) Prior Publication Data

US 2012/0250449 A1 Oct. 4, 2012

(30) Foreign Application Priority Data

Mar. 17, 2011 (JP) ..... 2011-058760

(51) Int. Cl.
*B01F 5/06* (2006.01)
*B01F 15/06* (2006.01)

(52) U.S. Cl.
USPC ..... 366/176.1; 366/149

(58) Field of Classification Search
USPC ..... 366/149, 14, 76.7, 81, 131, 152.1, 262, 366/268, 349, 132, 176.1
See application file for complete search history.

(56) References Cited

U.S. PATENT DOCUMENTS

| | | | | |
|---|---|---|---|---|
| 5,720,551 | A * | 2/1998 | Shechter | 366/176.1 |
| 7,284,899 | B2 * | 10/2007 | Nakano | 366/176.1 |
| 2004/0125690 | A1 * | 7/2004 | Sentmanat | 366/176.3 |
| 2005/0041523 | A1 | 2/2005 | Nakano | |

FOREIGN PATENT DOCUMENTS

| | | |
|---|---|---|
| JP | 8-89774 | 4/1996 |
| WO | WO 03/059497 | 7/2003 |

* cited by examiner

*Primary Examiner* — Tony G Soohoo
*Assistant Examiner* — Anshu Bhatia
(74) *Attorney, Agent, or Firm* — Hamre, Schumann, Mueller & Larson, P.C.

(57) ABSTRACT

A system for manufacturing an emulsified/dispersed liquid has first and second emulsification/dispersion devices which produce the emulsified/dispersed liquid by emulsifying/dispersing emulsification/dispersion material in a liquid mixture into a medium liquid in the liquid mixture. A multistage pressure/temperature control device of a multistage type cools the emulsified/dispersed liquid discharged by the second emulsification/dispersion device while applying a back-pressure which can prevent occurrence of bubbling to the first and second emulsification/dispersion devices. The multistage pressure/temperature control device reduces the pressure of the emulsified/dispersed liquid gradually or in stages, and finally lowers the pressure of the emulsified/dispersed liquid to a pressure that bubbling is not caused if the emulsification/dispersion liquid is released into an atmospheric condition. The system can apply sufficient shearing force to the liquid mixture so as to sufficiently atomize the emulsification/dispersion material.

9 Claims, 3 Drawing Sheets

SYSTEM FOR MANUFACTURING EMULSIFIED/DISPERSED LIQUID

BACKGROUND OF THE INVENTION

The present invention relates to a system for manufacturing an emulsified/dispersed liquid by emulsifying or dispersing predetermined materials into a medium liquid, in particular relates to a system for manufacturing an emulsified/dispersed liquid by applying a strong shearing force to a liquid mixture containing the medium liquid and the emulsification/dispersion material of solid state or liquid state which is not soluble into the medium liquid so as to emulsify or disperse the emulsification/dispersion material into the medium liquid fundamentally without using surfactants.

Generally, various surfactants are used when producing emulsified/dispersed liquid through emulsification or dispersion of a solid or liquid material into the medium liquid. However, when there is a possible human contact with the emulsified/dispersed liquid (for example, when the liquid is in foods or cosmetics), the surfactants may be harmful. To avoid the use of surfactants, various emulsification/dispersion devices are proposed. These devices focus on emulsifying or dispersing the medium liquid by adding a strong shearing force to the liquid material of medium liquid and liquid of solid form of emulsification/dispersion material that does not dissolve in medium liquid (for example, refer to JP 8-89774 A and WO 2003/059497).

With this type of emulsification/dispersion device, for example, the "high pressured jet" version or the "rotary churning" version of the emulsification/dispersion device is well known. For instance, with the high pressured jet version of the emulsification/dispersion device, highly pressured liquid mixture is sprayed through a nozzle, creating a jet stream. This stream is then clashed against the wall or turns around at the wall, and the liquid/liquid junction converts the kinetic energy of the jet stream into the shearing force energy required for the emulsification/dispersion process.

However, if the strong shearing force is applied to the liquid mixture in an unbalanced environment (namely, if an unbalanced pressure or speed exists), then the dissolved gas or the gas left within the medium liquid will turn into bubbles and the liquid mixture will begin bubbling. Due to these bubbling, excessive amounts of emulsification/dispersion material particles will be produced. To prevent such occurrence, the emulsification/dispersion device places back pressure on either the liquid mixture or the emulsified/dispersed liquid, in order to avoid bubbling from taking place.

Recent years at the market, highly emulsifible or dispersible material of the emulsified/dispersed liquid (namely, emulsified/dispersed liquid with extremely atomized emulsification/dispersion material) is demanded. To produce such liquid, a new emulsification/dispersion device is being developed. This device applies higher pressure to either medium liquid or liquid mixture in hopes of atomizing the emulsification/dispersion material. The only flaw of this device is that the occurrence of bubbling becomes a serious problem. Even though the increase of back pressure upon the liquid mixture or the emulsified/dispersed liquid prevented bubbling from occurring, this new process causes bubbling to occur due to an instant pressure depletion when the emulsified/dispersed liquid is drained from the emulsification/dispersion device.

If bubbling occurs within the emulsified/dispersed liquid, in the case of dispersing powder material on the medium liquid, air bubbles will stick upon the powder surface, and the wettability of the powder will worsen. In the case of emulsion, aerosol is easily formed, and the quality as a product of emulsified/dispersed liquid deteriorates. Also, energy losses will increase and energy efficiency will worsen because the created air bubbles absorb energy. In addition, if (for instance) an unsaturated fatty acid is used as an emulsification/dispersion material, the material will oxidize under the high temperature due to the oxygen within the air bubble. As a result, the products' qualities will deteriorate.

SUMMARY OF THE INVENTION

The present invention has been achieved to solve the conventional problems described above. Thus, the present invention has an object to provide a system for manufacturing an emulsified/dispersed liquid, which can apply sufficient shearing force to a liquid mixture containing a medium liquid and an emulsification/dispersion material of liquid state or solid state which is not soluble in the medium liquid so as to sufficiently atomize the emulsification/dispersion material, hence can .manufacture the emulsified/dispersed liquid of high quality with preventing occurrence of bubbling.

A system for manufacturing an emulsified/dispersed liquid according to the present invention which has been achieved to solve the above-mentioned problems, applies a shearing force to a liquid mixture containing a medium liquid (for example, water, methanol, ethanol, mixture of these substances or the like) and an emulsification/dispersion material of solid state or liquid state which is not soluble into the medium liquid so as to emulsify or disperse the emulsification/dispersion material (material to be emulsified and/or material to be dispersed) into the medium liquid so that the emulsified/dispersed liquid (emulsified liquid and/or dispersed liquid) is manufactured. In a fundamental aspect of the present invention, the system includes a liquid mixture supplying device, a liquid mixture pressurizing device, an emulsification/dispersion device and a multistage pressure/temperature control device.

In the system for manufacturing the emulsified/dispersed liquid according to the present invention, the liquid mixture supplying device supplies the liquid mixture containing the medium liquid and the emulsification/dispersion material to the liquid mixture pressurizing device. The liquid mixture pressurizing device pressurizes the liquid mixture supplied by the liquid mixture supplying device and discharges the pressurized liquid mixture to the emulsification/dispersion device. The emulsification/dispersion device is adapted to receive the pressurized liquid mixture discharged by the liquid mixture pressurizing device and generate a jet flow of the liquid mixture by transforming pressure energy of the liquid mixture to kinetic energy (motion energy) so as to emulsify/disperse the emulsification/dispersion material in the liquid mixture into the medium liquid in the liquid mixture by means of the shearing force generated by the jet flow to produce the emulsified/dispersed liquid and discharge the emulsified/dispersed liquid to the multistage pressure/temperature control device. The multistage pressure/temperature control device is adapted to receive the emulsified/dispersed liquid discharged by the emulsification/dispersion device and control temperature of the emulsified/dispersed liquid while lowering the pressure of the emulsified/dispersed liquid gradually or in stages, and simultaneously to apply a backpressure to the emulsified/dispersed liquid in the emulsification/dispersion device.

In the system for manufacturing the emulsified/dispersed liquid, the multistage pressure/temperature control device includes first to third controllers which are arranged in series from the upstream side to the downstream side with respect to a direction of a flow of the emulsified/dispersed liquid. Each of the first to third controllers has a shell (or outer tube)

through which a heat transfer medium passes and a heat transfer tube arranged in the shell, through which the emulsified/dispersed liquid passes. The heat transfer tubes of the first to third controllers are connected to one another in series. The inner diameters, total lengths and general shapes or piping configurations of the heat transfer tubes of the first to third controllers are designed on the basis of the flow rate and viscosity (or temperature) of the emulsified/dispersed liquid in the heat transfer tubes during the operation of the system so as to satisfy the relationship of $\Delta P_1 > \Delta P_3 > \Delta P_2$. In the above-mentioned relation, $\Delta P_1$, $\Delta P_2$ and $\Delta P_3$ are amounts of pressure drops in the heat transfer tubes of the first to third controllers, respectively.

In the system for manufacturing the emulsified/dispersed liquid according to the present invention, the inner diameters, total lengths and general shapes of the heat transfer tubes of the first to third controllers may be designed in such a manner that the emulsified/dispersed liquid flows in a laminar state (for example, Reynolds number of 100-2000) within the heat transfer tubes. Meanwhile, the inner diameters, total lengths and general shapes of the heat transfer tubes of the first to third controllers may be designed in such a manner that the emulsified/dispersed liquid flows in a turbulent state (for example, Reynolds number of 3000-50000) within the heat transfer tubes.

The system for manufacturing the emulsified/dispersed liquid according to the present invention may include a heat exchanger for heating or cooling the liquid mixture, which is arranged between the liquid mixture supplying device and the liquid mixture pressurizing device with respect to the direction of the flow of the emulsified/dispersed liquid. In this case, the liquid mixture supplying device may include a liquid mixture pump for pressurizing and feeding the liquid mixture to the liquid mixture pressurizing device through the heat exchanger.

In the system for manufacturing the emulsified/dispersed liquid according to the present invention, the emulsification/dispersion device may include first to third pore components (cell with a narrow pore) each of which includes a pore having a small inner diameter. The first to third pore components may be arranged in series from the upstream side to the downstream side with respect to the direction of the flow of the emulsified/dispersed liquid in such a manner that the pores of the first to third pore components are connected to one another in series. In this case, the inner diameters of the pores of the first to third pore components may be designed so as to satisfy the relationship of $d_2 > d_1 > d_3$. In the above-mentioned relationship, $d_1$, $d_2$ and $d_3$ are inner diameters of the pores of the first to third pore components.

In the system for manufacturing the emulsified/dispersed liquid according to the present invention, the emulsification/dispersion device may be composed of first and second emulsification/dispersion devices which are connected to each other in series. In this case, the system may include a first agent feeder arranged at the downstream side of the first emulsification/dispersion device, for adding a first additive agent to the emulsified/dispersed liquid, and a second agent feeder arranged at the downstream side of the second emulsification/dispersion device, for adding a second additive agent to the emulsified/dispersed liquid.

According to the present invention, because very high pressure is applied to the liquid mixture by the liquid mixture pressurizing device, a strong shearing force can be applied to the liquid mixture in the emulsification/dispersion device. Accordingly, the emulsification/dispersion material may be sufficiently atomized without using any surfactant. Moreover, because the backpressure is applied to the emulsified/dispersed liquid in the emulsification/dispersion device by the multistage pressure/temperature control device, occurrence of bubbling in the emulsification/dispersion device may be prevented. In addition, because the pressure of the emulsified/dispersed liquid is reduced gradually or in stages in the multistage pressure/temperature control device so that rapid or instant pressure drop is not caused, bubbling is not caused in the emulsified/dispersed liquid when the emulsified/dispersed liquid is released from the system to the outside of the system. Meanwhile, the temperature of the emulsified/dispersed liquid discharged from the system to the outside of the system can be controlled in a preferable manner. In consequence, the quality of the emulsified/dispersed liquid as a product may be improved and further loss of energy may be reduced so that energy efficiency of the system may be improved.

DETAILED DESCRIPTION OF THE PREFERRED EMBODIMENTS

Figure 1:
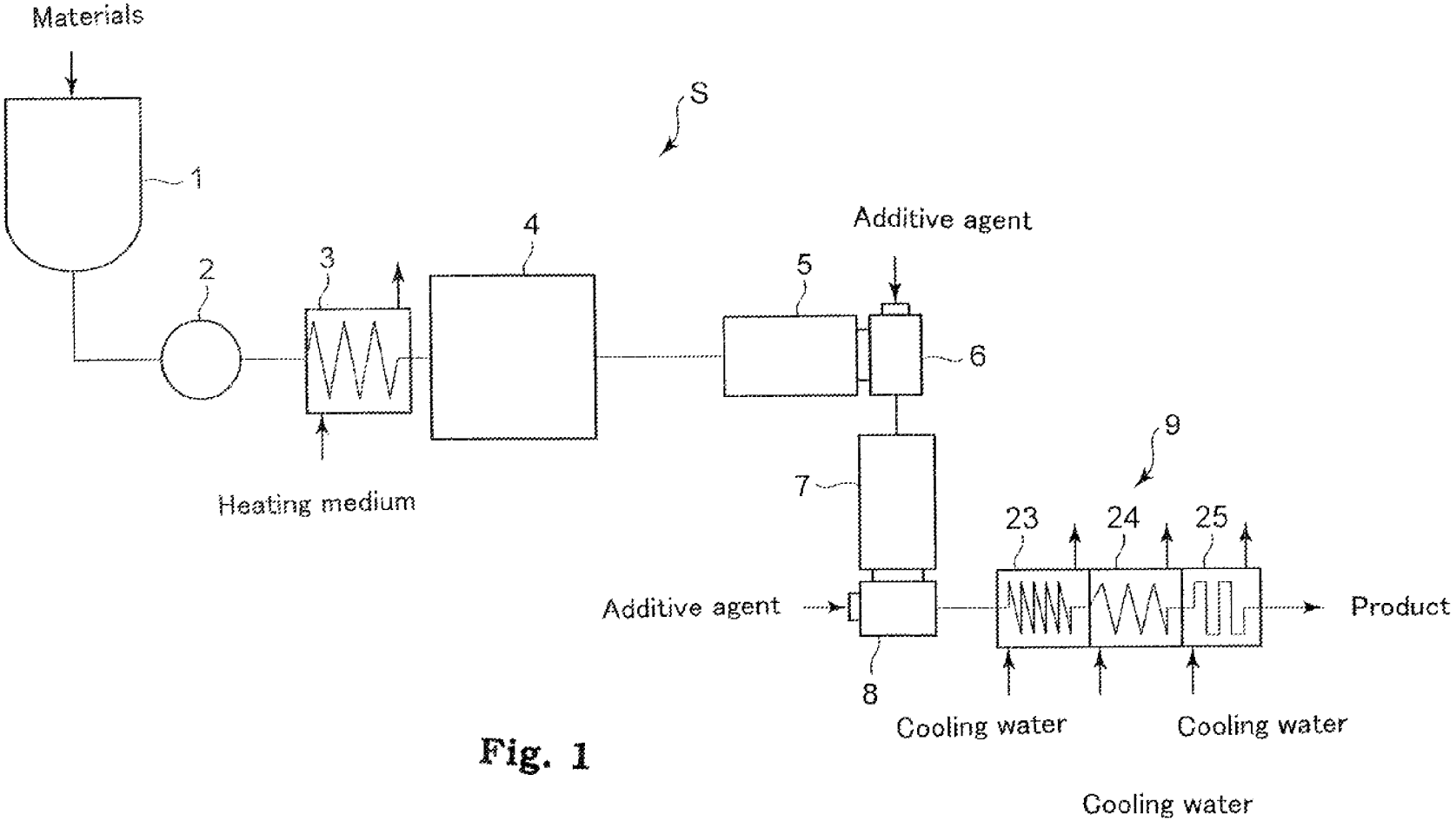
FIG. 1 is a schematic view showing a system for manufacturing emulsified/dispersed liquid according to the present invention.

From now on, the invention's ways of enforcement will be explained in details. First, the outline of the emulsified/dispersed liquid production system of this invention will be explained. The emulsification/dispersion device emulsifies/disperses the emulsification/dispersion material by applying a strong shearing force to the liquid mixture of medium liquid and liquid or solid form of emulsification/dispersion material. Generally, if the strong shearing force is applied in an unbalanced environment (namely, if the liquid mixture's balance of speed or pressure collapses), then bubbling will occur and the emulsification/dispersion material particles will become disproportionate. As a result, excessive amounts of emulsification/dispersion material particles will be produced. Conventionally, this invention applies extremely high pressure upon the liquid mixture in order to prevent bubbling from occurring.

However, when applying extremely high pressure upon the liquid mixture, immense amount of energy is used. Therefore, by equipping the multistage pressure/temperature control device to the downstream of the emulsification/dispersion device, the emulsified/dispersed liquid production system of this invention prevents bubbling from occurring without having to apply extremely high pressure to the liquid mixture. As a result, the size and/or the shape of the emulsification/dispersion material particles will stay similarly the same, while effectively preventing the production of excessive emulsification/dispersion material particles and lowering energy usage.

Concerning the basic technology ideas of the emulsified/dispersed liquid production system of this invention, if the outlet of the final product of emulsified/dispersed liquid (in other words, the position when the established emulsified/dispersed liquid is released in the atmospheric pressure) is considered the standard position, then the production system is organized to prevent pressure-depletion from occurring at the standard point and causing bubbling to take place. In other words, this invention places the original idea at the downstream side to support multiple conditions of injection energy etc. occurring at the upstream side. In addition, this emulsified/dispersed liquid production system will have a basic feature of having two devices—the emulsification/dispersion device that emulsifies/disperses the emulsification/dispersion material within the medium liquid and the multistage pressure/temperature control device that prevents bubbling—tandemly connect to each other.

The emulsification/dispersion device is made up of tandemly connected first to third pore components (in the order from upstream side to the downstream side regarding the emulsified/dispersed liquid's flow direction) with differing inner diameter that goes through the seal axially. Also, if the inner diameters of the first to third pore cells are expressed as $d_1$, $d_2$, $d_3$ respectively, then this emulsification/dispersion device has the feature of satisfying the diameters' relationship of $d_2>d_1>d_3$. Furthermore, the structure of this invention has been mentioned, and will be mentioned from now on as well, to have three pore components (first to third pore components) for the emulsification/dispersion device, but the emulsification/dispersion device can have four or more pore components if desired.

The multistage pressure/temperature control device consists of first to third control groups placed tandemly in the order from upstream side to downstream side of the emulsified/dispersed liquid's flow direction. For each of the first to third control group, there is a shell (or an outer pipe) that the heating medium circulates upon. Located within the shell is a heat-transfer pipe where the emulsified/dispersed liquid circulates. Each heat-transfer pipe of the first to third control group is tandemly connected. In addition, while applying necessary amount of back pressure in response to the staged emulsification/dispersion device, the multistage pressure/temperature progressively decreases the back pressure applied upon each control group. At this point, first to third control group lowers the pressure of the emulsified/dispersed liquid to the level that bubbling will not occur (for example, similar level to atmospheric pressure), while cooling the liquid to a designated temperature (for example, room temperature)

Regarding the multistage pressure/temperature control device, the inner diameter, overall length, and the general shape or the pipe form of the first to third control groups are set to satisfy the relationship between each control groups' pressure-depletion quantity (expressed as $\Delta P_1$, $\Delta P_2$, $\Delta P_3$, respectively) as $\Delta P_1>\Delta P_3>\Delta P_2$, in respect to the speed (average speed) and viscosity (or temperature) of the emulsified/dispersed liquid within each heat-transfer pipe. Furthermore, for each joint of the heat-transfer pipe there is an area where the tube expands to stop pressure depletion from occurring before and after the joint. In other words, since the amount of pressure depletion in the multistage pressure/temperature control device can be considered as the total amount of pressure depletion in the three control groups (or the heat-transfer pipe), the multistage pressure/temperature control device is made to set up flow resistance level and pressure-depletion quantity in response to the amount of back pressure required for emulsification/dispersion device. Even with such system, the level of flow resistant and/or the amount of pressure depletion is determined by each of the three heat-transfer pipes' inner diameter and suitable length, as well as the average speed (of specified place) and the viscosity or the average temperature (of specified place).

In addition, the multistage pressure/temperature control device is able to control the emulsified/dispersed liquids' temperature by adjusting the supply temperature and the amount of the heating medium flowing within each cell of first to third control groups. For example, by adjusting the amount of heating medium and coolant that are being drained into each cell, the temperature of the emulsified/dispersed liquid found within the multistage pressure/temperature control device or the temperature of the emulsified/dispersed liquid being ejected from the device can be cooled to the designated temperature.

In addition, as the emulsified/dispersed liquids' temperature is controlled by adjusting the supply temperature and the flow amount of the heating medium within each cell of first to third control group, the viscosity of the emulsified/dispersed liquid, as well as the flow resistance and pressure-depletion quantity of the heat-transfer pipe can be subordinately controlled. Certainly, the flow resistance and/or the pressure-depletion quantity of each heat-transfer pipe located in the first to third control group can be controlled by the heat-transfer pipes' inner diameter and the suitable length, as well as the speed of the emulsified/dispersed liquid located within the each pipe.

The structure of this invention has been mentioned, and will be mentioned from now on as well, to have three pore components (first to third pore components) for the emulsification/dispersion device, but the emulsification/dispersion device can have four or more pore components if desired. For example, if the pressure of the liquid mixture and the pressure within the emulsification/dispersion device is increased, the multistage pressure/temperature control device can be arranged to have a first to fourth control group or a first to fifth control group in order to prevent bubbling from occurring. These control groups can be set to slow the degree of change of the gradual pressure-depletion within the multistage pressure/temperature control device.

The multistage pressure/temperature control device of this invention can be applied to both rotational type and high-pressured type of the emulsification/dispersion device. In both of these cases, the multistage pressure/temperature control is still able to prevent bubbling by applying necessary back pressure to the emulsification/dispersion device. At the same time, the multistage pressure/temperature control device is able to gradually lower this back pressure to the similar level as atmospheric pressure. This prevents the emulsified/dispersed liquid from bubbling when released under atmospheric pressure.

From now on, emulsified/dispersed liquid production system's structure, as well as function, will be explained in details while referring to the attached drawings.

As shown in FIG. 1, an emulsified/dispersed liquid production system S includes (in the order from upstream to the downstream) a liquid mixture supplying tank 1, a liquid mixture sending pump 2, a heat-exchanger 3, a liquid mixture pressurizing pump 4, a first emulsification/dispersion device 5, a first additive supply port 6, a second emulsification/dispersion device 7, a second additive supply port 8, and a multistage pressure/temperature control device 9, in regards to the flow direction of the liquid mixture (raw material) or the emulsified/dispersed liquid (final product).

The liquid mixture supplying tank 1 is accumulated with a liquid mixture of a medium liquid (for example, water) and a liquid or solid form of emulsification/dispersion material that does not dissolve in the medium liquid. The drawing does not show the details, but there is a churning machine attached to the liquid mixture supplying tank 1. This machine ordinarily churns the liquid mixture to macroscopically distribute the emulsification/dispersion material equally within the medium liquid. The "emulsification/dispersion material" mentioned here is the material that will be emulsified or dispersed within the medium liquid.

The liquid mixture in the liquid mixture supplying tank 1, under designated flow quantity and with the help of the liquid mixture sending pump 2, travels through the heat exchanger in order to supply the liquid mixture pressurizing pump 4. The heat exchanger 3 uses an appropriate heat-transfer medium, such as steam, hot water (for example, 80-100° C.), hot mineral oil (for example, 100-500° C.) etc, to heat the liquid mixture to a designated temperature that best suits to emulsify/disperse the emulsification/dispersion material in the water. As for the heat exchanger 3, for example, a double-piped heat exchanger, a coil-typed heat exchanger, a plate-type heat exchanger etc. can be used as well. Also, depending on the situation, the heat exchanger will cool the liquid mixture, rather than to heat it. In this case, for a heat-transfer medium, cold water (for example, 0-5° C.), cold refrigerant (for example, −20-0° C.) etc. can be used. If there is no need to adjust the temperature of the liquid mixture, then the heat exchanger 3 can be removed.

The liquid mixture pressurizing pump 4 applies pressure, for example 30-300 MPa (300-3000 bar), to the supplied liquid mixture that traveled through the heat exchanger 3 from the liquid mixtures sending pump 2. Then, the liquid mixture pressurizing pump 4 ejects the liquid mixture to the downstream side. Afterwards, the high-pressured liquid mixture ejected from the liquid mixture pressurizing pump 4 is sent to the first emulsification/dispersion device 5 while maintaining its high pressure. The first emulsification/dispersion device 5, later explained in details, uses the liquid/liquid's shear (created by the jet stream) to produce emulsified/dispersed liquid by emulsifying/dispersing the emulsification/dispersion material within the medium liquid. Then, the resulting emulsified/dispersed liquid is ejected to the downstream side. If a portion of the emulsification/dispersion material did not emulsify/disperse in the medium liquid, the emulsification/dispersion material will be fully emulsified/dispersed by the second emulsification/dispersion device 7 (later explained). The "emulsified/dispersed liquid" mentioned here is the liquid that has a to-be-emulsified and/or to-be-dispersed material emulsifying or dispersing within the medium liquid (emulsion, suspension etc).

The emulsified/dispersed liquid ejected from the first emulsification/dispersion device 5 travels through the first additive supply port 6 and is sent to the second emulsification/dispersion device 7. At the first additive supply port 6, a designated the first additive supply is added to the emulsified/dispersed liquid. The first additive supply can be one type or multiple types of additive supply. Because the emulsified/dispersed liquid within the first additive supply port 6 is high-pressured, the first additive supply is inserted in the port with pressure (not shown). If not necessary, the first additive supply does not have to be added to the emulsified/dispersed liquid.

Then, the emulsified/dispersed liquid with the added first additive supply is ejected from the first additive supply port 6, and is sent to the second emulsification/dispersion device 7. The second emulsification/dispersion device 7 is responsible for using the same procedure as the first emulsification/dispersion device 5 (using the liquid/liquid's shear to produce emulsified/dispersed liquid by emulsifying/dispersing the emulsification/dispersion material within the medium liquid) to fully emulsifying or dispersing the emulsification/dispersion material within the emulsified/dispersed liquid received from the first emulsification/dispersion device 5, and later ejecting the liquid to the downstream side. If the received emulsified/dispersed liquid has fully emulsified or dispersed emulsification/dispersion materials by the first emulsification/dispersion device 5, then the second emulsification/dispersion device 7 can be removed.

The emulsified/dispersed liquid ejected from the second emulsification/dispersion device 7 travels through the second additive supply port 8 and is sent to the multistage pressure/temperature control device 9. At the second additive supply port 8, a designated second additive supply is added to the emulsified/dispersed liquid. The second additive supply can be one type or multiple types of additive supply. Because the emulsified/dispersed liquid within the second additive supply port 8 is high-pressured, the second additive supply is inserted in the port with pressure (not shown). If not necessary, the second additive supply does not have to be added to the emulsified/dispersed liquid.

Then, the emulsified/dispersed liquid with the added the second additive supply is ejected from the second additive supply port 8, and is sent to the multistage pressure/temperature control device. Later explained in details, the multistage pressure/temperature control device applies a designated back pressure to the emulsified/dispersed liquid within the second emulsification/dispersion device 7 and the emulsified/dispersed liquid within the first emulsification/dispersion device 5, and prevents bubbling from occurring within both the first emulsification/dispersion device 5 and the second emulsification/dispersion device 7. At the same time, the produced emulsified/dispersed liquid's pressure is progressively lowered, and the pressure of the emulsified/dispersed liquid at the exit area of the multistage pressure/temperature control device is lowered to be similarly the same as the atmospheric pressure. This prevents bubbling from taking place when the emulsified/dispersed liquid is released into the atmospheric pressure.

Figure 2:
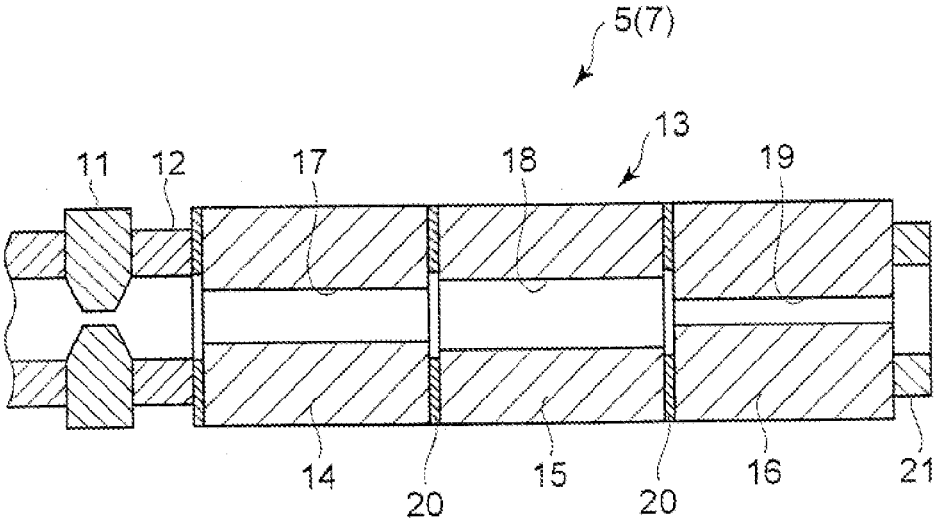
FIG. 2 is a schematic section view of first or second emulsification/dispersion device which configures the system for manufacturing the emulsified/dispersed liquid shown in FIG. 1.

FIG. 2 schematically shows the structure of the first emulsification/dispersion device 5. Because the structure, as well as function, of the second emulsification/dispersion device is substantially the same as the first emulsification/dispersion device shown in FIG. 2, only the structure and function of the first emulsification/dispersion device will be explained from now on (in order to avoid repetition). As shown in FIG. 2, the first emulsification/dispersion device 5 is tandemly connected with one another. The device includes a nozzle component 11, a cylinder passageway component 12, and a body section of the shortened column 13.

Here, the center axis the nozzle component 11, the passageway component 12, and the body section 13 are all aligned with each other, creating a center axis common to all three components. The body section 13 is equipped with the first pore component 14, the second pore component 15, and the third pore component 16 (collectively expressed as the first to third pore components 14-16) lined in order from upstream side to downstream side, in regards to the flow direction (in FIG. 2, the right direction) of the liquid or emulsified/dispersed liquid. Each of the first to third pore components 14-16 includes a cylinder, a first pore 17, a second pore 18, and a third pore 19 (collectively expressed as first to third pores 17-19) that penetrates through the first to third pore components 14-16 in the direction of the center axis of each pore component. The first to third pore components 14-16 are reciprocally connected by going through the ring-shaped seal component 20.

If the inner diameters of the first to third pores 17-19 of the first to third pore components 14-16 are expressed as $d_1$, $d_2$, and $d_3$, then the diameters are set to satisfy the relationship of $d_2>d_1>d_3$. The inner diameter of the cylinder passageway component 12 is set to be greater than $d_2$. Furthermore, the inner diameter of the passageway component 12 can be the same as $d_2$. Also, the inner diameter of each of the seal component 20 is set to be greater than $d_2$. In response to the liquid mixture's or the emulsified/dispersed liquid's condition, the inner diameters of the first to third pore components 14-16 are preferably set between the range of 0.4-4 mm, and the lengths to be between 4~40 mm. Again in response to the liquid mixture's or the emulsified/dispersed liquid's condition, the inner diameters of nozzle component 11 are preferably set between the range of 0.1-0.5 mm, and the lengths to be between 1-4 mm. The seal component 20's inner diameter is preferably set within the range of 2-8 mm.

Regarding the first emulsification/dispersion device 5, the relatively narrow first pore component 13 or the first pore 17 applies a designated back pressure to the liquid mixture found within relatively wide passageway component 12. Also, the most narrow third pore component 16 or third pore 19 applies a designated back pressure to the liquid mixture or the emulsified/dispersed liquid found within the most wide second pore component 15 or second pore component 18. As explained before, the inner diameter of the ring-shaped seal component 20 is greater than $d_2$ (the inner diameter of the most wide second pore component 15 or second pore component 18). Therefore, by instantaneously relaxing the pressure of the liquid mixture or the emulsified/dispersed liquid, each of the first to third pore components 14-16 is able to produce an individualized pressure-depletion system.

The first emulsification/dispersion device 5 is capable of applying adequate amount of back pressure to prevent bubbling from occurring as a result of the strongest shearing force produced by passageway component 12. Also, the most narrow third pore component 16 or third pore 19 applies back pressure (that does not cause bubbling due the relaxation) in response to the widest second pore component 15's pressure-relaxation. Furthermore, the inner diameter of the cylinder-shaped connective component 21—a communicating tube at the downstream side of the third pore component 16 that connects to the first additive supply port 6—is sufficiently larger than $d_3$ (inner diameter of the third pore component 16 or the third pore 19).

The liquid mixture that has been applied high pressure, such as 30-300 MPa (300-3000 bar), due to the liquid mixture pressurizing pump 4 is converted into a high-speed jet stream, and is sprayed into the passageway component 12. Then, the jet stream sprayed into the passageway component 12 adds a strong shearing force to the surrounding liquid mixture, and causes the emulsification/dispersion material to emulsify/disperse. Later, the liquid mixture's jet stream flows into the first to third pore components 14-16, while losing kinetic energy. Afterwards, the jet stream adds a strong shearing force to the liquid mixture existing within first to third pore components 14-16, and causes the emulsification/dispersion material to emulsify/disperse.

The first to third pore components 14-16 include pores with small diameter that gradually loses kinetic energy (for example, shear energy and heat energy). This kinetic energy is converted from the kinetic energy of the liquid mixtures' jet stream as a result of liquid/liquid's shear existing between the jet stream and the surrounding liquid mixture. Setting up the inner diameter and the stage number of first to third pore components 14-16 or first to third pores 17-19 are significantly important in producing a powerful emulsification or dispersion without producing bubbles.

Because high pressure is applied to the liquid mixture due to the liquid mixture pressurizing pump 4, the first emulsification/dispersion device 5 and the second emulsification/dispersion device 7 (collectively written as first and second emulsification/dispersion device 5, 7) is able to apply strong shearing forces to the liquid mixture, and thoroughly atomize the emulsification/dispersion material. Also, bubbling is prevented from taking place within first and second emulsification/dispersion device 5, 7 because the multistage pressure/temperature control device 9 (explained later) applies back pressure to first and second emulsification/dispersion device 5, 7.

The first to third pore components 14-16 shown in FIG. 2 is individually structured by a single cylindrical component with differing inner diameter. However, each of the first to third pore components 14-16 can be structured with multiple (for example, 2-3) cylindrical components. In this case, each of the pore components 14-16 should preferably have seal component 20 between each cylindrical component.

FIG. 2 schematically, shows the structure of the multistage pressure/temperature control device 9. The multistage pressure/temperature control device 9 receives the emulsified/dispersed liquid that came from second emulsification/dispersion device 7 and traveled through the second additive supply port 8. Then, the multistage pressure/temperature control device 9 progressively lowers the pressure of the received emulsified/dispersed liquid, and at the same time, applies back pressure to the emulsified/dispersed liquid within the first and second emulsification/dispersion device 5, 7. Also, the multistage pressure/temperature control device 9 cools the heated emulsified/dispersed liquid (due to emulsification/dispersion caused by shearing force) to a designated temperature, such as room temperature (20-30° C.).

Figure 3:
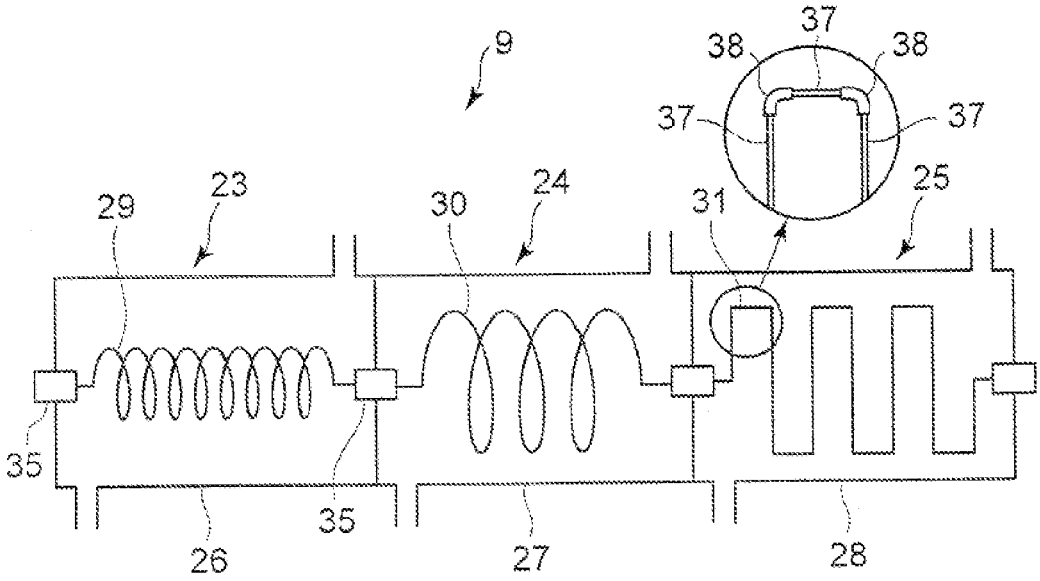
FIG. 3 is a schematic view of a multistage pressure/temperature control device which configures the system for manufacturing the emulsified/dispersed liquid shown in FIG. 1.

As shown in FIG. 3, the multistage pressure/temperature control device is equipped with tandemly connected first to third control groups 23-25, in the order from the upstream side to the downstream side according to the emulsified/dispersed liquids' flow direction (in FIG. 3, the right direction). The first control group 23 consists of a first shell 26 where the coolant (heating medium) circulates. Located within this first shell 26 is a first heat-transfer pipe 29 where the emulsified/dispersed liquid circulates. The second control group 24 includes a second shell 27 where the coolant circulates. Located within this second shell 27 is a second heat-transfer pipe 30 where the emulsified/dispersed liquid circulates. The third control group 25 consists of a third shell 28 where the coolant circulates. Located within this third shell 28 is a third heat-transfer pipe 31 where the emulsified/dispersed liquid circulates.

Regarding the multistage pressure/temperature control device 9, the crosscut of the first to third heat-transfer pipes 29-31 is circular and is tandemly connected with each other while going through a communication component 35. Furthermore, the edge of the first heat-transfer pipe 29 on the upstream side (referring to the emulsified/dispersed liquid's flow direction) and the edge of the third heat-transfer pipe 31 on the downstream side goes through the communication component 35, and the edges are connected to the pipe located in the upstream side and the downstream side, respectively.

Regarding the multistage pressure/temperature control device, the inner diameter, overall length, and the general shape or the pipe form (piping, configuration) of the first to third heat-transfer pipes 29-31 are set to satisfy the relationship between each pipes' pressure-depletion quantity (expressed as $\Delta P_1$, $\Delta P_2$, $\Delta P_3$, respectively) as $\Delta P_1>\Delta P_3>\Delta P_2$, with speed, viscosity, and density of the emulsified/dispersed liquid within each heat-transfer pipe in consideration. In other words, to produce an emulsified/dispersed liquid with desired quality and composition, the inner diameter, overall length, and the general shape or the pipe form of first to third heat-transfer pipes 29-31 must be chosen after setting the speed, viscosity, and density of the emulsified/dispersed liquid within each heat-transfer pipe to the favorable condition.

The idea of setting of $\Delta P_1$-$\Delta P_3$ of the first to third heat-transfer pipes 29-31 to satisfy the relationship of $\Delta P_1>P_3>\Delta P_2$ is based off of the experiment result given by the inventor, after combining various pressure-depletion values of first to third heat-transfer pipes 29-31 and testing whether or not bubbling occurs. From this experiment, the preferable combination of pressure-depletion values will not cause bubbling only if the above conditions are satisfied. If not satisfied, then bubbling will occur as proven in the experiment.

As explained before, the inner diameter, overall length, and the general shape or the pipe form of the first to third heat-transfer pipes 29-31 are set to satisfy the relationship of $\Delta P_1>\Delta P_3>\Delta P_2$, in respect to speed, viscosity, and density of the emulsified/dispersed liquid within each heat-transfer pipe. Along with this way of finding $\Delta P_1$-$\Delta P_3$, the technique explained below can be used to calculate or estimate the pressure-depletion values.

<If the Emulsified/Dispersed Liquid is in a Laminar Flow>

First, the method of calculating the $\Delta P_1$-$\Delta P_3$ when the emulsified/dispersed liquid is flowing as a laminar flow within the first to third heat-transfer pipes 29-31 will be explained. In this case, if the inner diameter of first to third heat-transfer pipes 29-31 is expressed as $D_1$-$D_3$, the suitable length as $Le_1$-$Le_2$, the flow speed of the emulsified/dispersed liquid within first to third heat-transfer pipes 29-31 as $U_1$-$U_3$, the emulsified/dispersed liquid's viscosity as $\mu_1$-$\mu_3$, and the gravity conversion factor as g(9.8 kg·m/Kg·sec$^2$), each of the pressure-depletion quantity $\Delta P_1$-$\Delta P_3$ can be calculated using the Hagen-Poiseuille equation written below.

$$\Delta P_1=32\cdot U_1\cdot Le_1\cdot\mu_1/(g\cdot D_1^2) \quad \text{equation 1}$$

$$\Delta P_2=32\cdot U_2\cdot Le_2\cdot\mu_2/(g\cdot D_2^2) \quad \text{equation 2}$$

$$\Delta P_3=32\cdot U_3\cdot Le_3\cdot\mu_3/(g\cdot D_3^2) \quad \text{equation 3}$$

The "suitable length Le" mentioned above is the length of the pipe that causes the same amount of pressure-depletion or pressure-loss as the various form of heat-transfer pipe, and has the same inner diameter as the heat-transfer pipe (the same applies for when the emulsified/dispersed liquid flows turbulently). In other words, this invention is made so that the Hagen-Poiseuille equation can be used, even if various type of heat-transfer pipe with various types of pipe joints and various shapes exist, just by replacing (identifying) it with a pipe that causes the same amount of pressure-depletion or pressure-loss. The calculation of the "suitable length" of the various-shaped pipe or pipe joint will only be explained briefly because the method of calculation is well know to this company. If the cross-section of the first to third heat-transfer pipes 29-31 is not circular (for example, oval, square, rectangle etc.), use the equation "4×cross-sectional area/wetted perimeter" to find the suitable diameter, in place of the inner diameter $D_1$-$D_3$ (the same applies for when the emulsified/dispersed liquid flows turbulently).

When emulsified/dispersed liquid is flowing in a laminar flow within the first to third heat-transfer pipes 29-31 (namely, when the Reynolds number is roughly below 2300), the pressure-depletion or pressure-loss quantity of the first to third heat-transfer pipes 29-31 can be calculated by using the equations 1-3 (Hagen-Poiseuille), regardless of the roughness of the heat-transfer pipe's surface. Furthermore, if the emulsified/dispersed liquid's viscosity $\mu$ is 3.6 kg/m·hr (1 centipoise), the density $\rho$ is 1000 kg/m$^3$, the flow speed U is 1800 m/hr (0.5 m/sec), and the heat-transfer pipe's inner diameter D is 0.002 m (2 mm), then the Reynolds number of the emulsified/dispersed liquid found within the heat-transfer pipe will be 1000 (as shown below); therefore, the emulsified/dispersed liquid's flow is a laminar flow.

$$Re=D\cdot U\cdot\rho/\mu=0.002\times1800\times1000/3.6=1000$$

If the emulsified/dispersed liquid will flow in a laminar flow within the first to third heat-transfer pipes 29-31, the emulsified/dispersed liquid's temperature, flow speed, density, and viscosity must be set first. Then, while using equations 1-3 to find the pressure-depletion quantities $\Delta P_1$-$\Delta P_3$ that satisfies the relationship $\Delta P_1>\Delta P_3>\Delta P_2$, determine the inner diameter, overall length, and general shape or the pipe form of first to third heat-transfer pipes 29-31.

<If the Emulsified/Dispersed Liquid Flows Turbulently>

Next, the method of calculating the $\Delta P_1$-$\Delta P_3$ when the emulsified/dispersed liquid flows turbulently within the first to third heat-transfer pipes 29-31 will be explained. In this case, if first to third heat-transfer pipes 29-31 are smooth pipes, the pressure depletion quantity $\Delta P_1$-$\Delta P_3$ can each be calculated using Karman-Nikuradse equation (written below as equations 4-6). For each of the first to third heat-transfer pipe 29-31 of the emulsified/dispersed liquid production system S, smooth pipes are used (for example, a smooth stainless steel pipe, copper pipe etc. with an inner surface that has the same roughness as a glass pipe).

$$\Delta P_1=4\cdot f_1\cdot[\rho_1\cdot U_1^2/(2\cdot g)]\cdot(Le_1/D_1) \quad \text{equation 4}$$

However, $1/f_1^{0.5}=4\cdot\log[(D_1\cdot U_1\cdot\rho_1/\mu_1)\cdot f_1^{0.5}]-0.4$ $$\Delta P_2=4\cdot f_2\cdot[\rho_2\cdot U_2^2/(2\cdot g)]\cdot(Le_2/D_2) \quad \text{equation 5}$$

However, $1/f_2^{0.5}=4\cdot\log[(D_2\cdot U_2\cdot\rho_2/\mu_2)\cdot f_2^{0.5}]-0.4$ $$\Delta P_3=4\cdot f_3\cdot[\rho_3\cdot U_3^2/(2\cdot g)]\cdot(Le_3/D_3) \quad \text{equation 4}$$

However, $1/f_3^{0.5}=4\cdot\log[(D_3\cdot U_3\cdot\rho_3/\mu_3)\cdot f_3^{0.5}]-0.4$ In equations 4-6, $\rho_1$-$\rho_3$ refers to the density of the emulsified/dispersed liquid flowing within first to third heat-transfer pipes 29-31. Also, $f_1$-$f_3$ refers to the coefficient of friction of first to third heat-transfer pipes 29-31. Because first to third heat-transfer pipes 29-31 are smooth pipes, $f_1$-$f_3$ are the Reynolds numbers. The other symbols of this equation have the same meaning as equations 1-3 (when the emulsified/dispersed liquid is flowing in a laminar flow).

When emulsified/dispersed liquid is flowing turbulently within the first to third heat-transfer pipes 29-31 (namely, when the Reynolds number is roughly over 2300), the pressure-depletion or pressure-loss quantity of the first to third heat-transfer pipes 29-31 can be calculated by using the equations 4-6 (Karman-Nikuradse), as long as the heat-transfer pipe is smooth. Furthermore, if the emulsified/dispersed liquid's viscosity $\mu$ is 3.6 kg/m·hr (1 centipoise), the density $\rho$ is 1000 kg/m$^3$, the flow speed U is 3600 m/hr (1 m/sec), and the heat-transfer pipe's inner diameter D is 0.003 m (3 mm), then the Reynolds number of the emulsified/dispersed liquid found within the heat-transfer pipe will be 3000 (as shown below); therefore, the emulsified/dispersed liquid flows turbulently.

$$Re=D\cdot U\cdot\rho/\mu=0.003\times3600\times1000/3.6=3000$$

If the emulsified/dispersed liquid flows turbulently within the first to third heat-transfer pipes 29-31, the emulsified/dispersed liquid's temperature, flow speed, density, and viscosity must be set first. Then, while using equations 1-3 to find the pressure-depletion quantities $\Delta P_1$-$\Delta P_3$ that satisfies the relationship $\Delta P_1 > \Delta P_3 > \Delta P_2$, determine the inner diameter, overall length, and general shape or the pipe form of the first to third heat-transfer pipes 29-31.

As explained previously regarding multistage pressure/temperature control device 9, the inner diameter, overall length, and the general shape or the pipe form of the first to third heat-transfer pipes 29-31 are favorably determined to satisfy the relationship of $\Delta P_1 > \Delta P_3 > P_2$, with speed, viscosity, and density of the emulsified/dispersed liquid within each heat-transfer pipe in consideration. In this enforcement method, the heat-transfer pipe 29 and the second heat-transfer pipe 30 are coil-shaped pipe (spiraled pipe).

In order to maximize the pressure-depletion quantity $\Delta P_1$, the inner diameter of the first heat-transfer pipe 29 is relatively small, the overall length of the pipe is relatively long, the coil's diameter is relatively small, and the coil pitch is relatively small: In other words, the first heat-transfer pipe 29 is a coil-shaped pipe that has a small diameter and is closely winded. On the other hand, in order to minimize the pressure-depletion quantity $\Delta P_2$, the inner diameter of the second heat-transfer pipe 30 is relatively large, the overall length of the pipe is relatively short, the coil's diameter is relatively small, and the coil pitch is relatively small. In other words, the second heat-transfer pipe 29 is a coil-shaped pipe that has a large diameter and is sparsely winded.

The third heat-transfer pipe 31 has a pipe with a general shape or pipe form of rectangular waves (repeated rectangular roughness). Also, as shown in the magnified view in FIG. 3, the third heat-transfer pipe 31 is structured assembly by the multiple straight pipes 37, all connected at the corner using 90° elbow 38. Here, the inner diameter of the straight pipe 37 and the shape of 90° elbow 38 are set so that the pressure-depletion quantity of third heat-transfer pipe 31, $\Delta P_3$, is smaller than first heat-transfer pipe 29's. $\Delta P_1$, yet greater than second heat-transfer pipe 30's. $\Delta P_2$. Furthermore, the third heat-transfer pipe 31 can be broken down into parts and can easily be cleaned.

A sample of the measurements and overall shape of first to third heat-transfer pipes 29-31 is written below.

<First Heat-Transfer Pipe>

| | |
|---|---|
| Inner Diameter $D_1$ | 1 mm |
| Overall Length $L_1$ | 5 m |
| Suitable Length $Le_1$ | 6 m |
| Overall Shape | Coil-shaped (spiral)<br>Coil's diameter: 50 mm<br>Coil pitch: 15 mm |

<Second Heat-Transfer Pipe>

| | |
|---|---|
| Inner Diameter $D_2$ | 3 mm |
| Overall Length $L_2$ | 3 m |
| Suitable Length $Le_2$ | 3.5 m |
| Overall Shape | Coil-shaped (spiral)<br>Coil's diameter: 100 mm<br>Coil pitch: 30 mm |

<First Heat-Transfer Pipe>

| | |
|---|---|
| Inner Diameter $D_1$ | 2 mm |
| Overall Length $L_1$ | 4 m |
| Suitable Length $Le_1$ | 4.5 m |
| Overall Shape | Rectangular waves<br>1 rectangle's width: 10 mm<br>1 rectangle's length: 20 mm |

Figure 4:
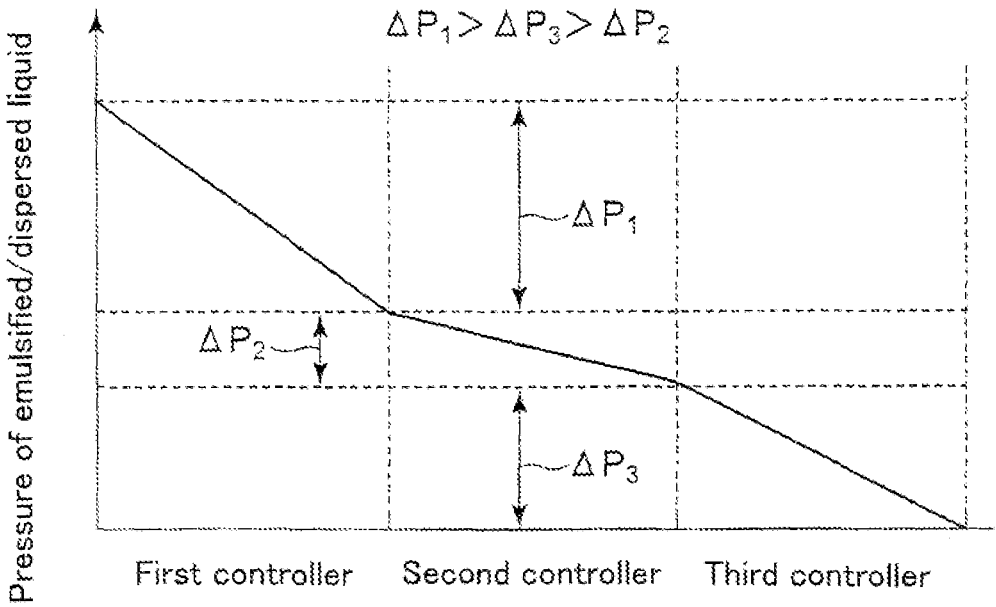
FIG. 4 is a graph which expresses the state of pressure changes of the emulsified/dispersed liquid within the multistage pressure/temperature device.

In FIG. 4, a sample of the positional pressure change of the emulsified/dispersed liquid within first to third control groups 23-25 (first to third heat-transfer pipe 29~31) of the multistage pressure/temperature control device is shown. Within the multistage pressure/temperature control device (as shown in FIG. 4), the emulsified/dispersed liquid's pressure is gradually decreasing, and by the end of the third control group 25 (third heat-transfer pipe 31), the pressure has become the same or nearly the same as atmospheric pressure. Like this, the pressure within the multistage pressure/temperature control device does not suddenly or instantaneously decrease, due to the gradual pressure-depletion. For this reason, when the emulsified/dispersed liquid is ejected out of the emulsified/dispersed liquid production system S, bubbling does not occur within the emulsified/dispersed liquid. At the same time, the temperature of the emulsified/dispersed liquid being drained from the production system is favorably controlled. As a result, the quality of the emulsified/dispersed liquid product can be improve, while increasing energy efficiency and reducing energy loss.

While setting a required amount of back pressure—amount that prevents bubbling from taking place—for the first and second emulsification/dispersion devices 5, 7, the multistage pressure/temperature control device 9 is able to progressively lower this back pressure to a level that bubbling will not occur when exposed to the atmosphere. At this time, by favorably combining the inner diameter or the suitable inner diameter, overall length (pipe's length) or the suitable length, and the overall shape of first to third heat-transfer pipes 29-31, the heat-transfer pipes are able to withstand (with a high degree of freedom) the back pressure or the pressure-depletion level of the back pressure.

For the emulsified/dispersed liquid production system S, water or other various types of medium liquid (for example, methanol, ethanol, or liquid mixture of both etc.) can be used. Also, the medium liquid in critical conditions can be used to emulsify or disperse the emulsification/dispersion materials. For example, if the medium liquid is water and the emulsification/dispersion material is a lecithin of glycerophospholipid, the emulsification/dispersion material can be emulsified or dispersed with the following process.

First, pour in a designated amount of water, lecithin, and other necessary additive supply into the churning machine to be churned. Afterwards, a liquid mixture with equally distributed corpuscles of lecithin and the additive supply is prepared macroscopically within the medium liquid (in this case, water). Then, the liquid mixture travels through the heat exchanger 3 with a designated amount of flow (due to pressure-sending, pump 2), and is supplied to the liquid mixture pressurizing pump 4. At this point, due to the heat exchanger 3 and the liquid mixture pressurizing pump 4, the liquid mixture is heated above the water's (medium liquid) critical temperature of 374.2° C. (for example, 400° C.), and is pressurized above the water's critical pressure of 218.4 atmospheric pressure (for example, 1,000 atmospheric pressure), in order to make the liquid mixture into critical condition.

The liquid mixture in critical condition is now supplied to both of the first emulsification/dispersion device 5 and the second emulsification/dispersion device 7. Furthermore, if needed, a designated additive supply is added to the liquid mixture from the first and second additive supply device 6, 8.

Because the water—the medium liquid—is in critical condition, the water-insoluble emulsification/dispersion material of lecithin etc. is easily emulsified or dispersed in water. With this condition, the liquid mixture is sprayed into both first emulsification/dispersion device 5 and the second emulsification/dispersion device 7. Due to the strong shearing force resulting from the spray, the emulsification/dispersion of the water-insoluble emulsification/dispersion material of lecithin etc. has been accelerated. For this reason, the water-insoluble emulsification/dispersion material of lecithin etc. can be emulsified or dispersed in the water without using surfactants.

Because back pressure will be applied (due to the multistage pressure/temperature control device 9) to the high temperature and high-pressured liquid mixture or emulsified/dispersed liquid located inside both first emulsification/dispersion device 5 and the second emulsification/dispersion device 7, bubbling does not occur within these two emulsification/dispersion devices. Inside the multistage pressure/temperature control device 9, the emulsified/dispersed liquid ejected from the second emulsification/dispersion device 7 is cooled to the designated temperature (for example, room temperature), and the pressure is lowered gradually to the designated pressure (for example, atmospheric pressure). Because the emulsified/dispersed liquid is cooled and the pressure is gradually lowered, bubbling does not occur when the emulsified/dispersed liquid is located inside the multistage pressure/temperature control device 9, as well as when it is ejected out of the device. In addition, after a strong shearing force is applied to the liquid mixture in critical condition, the liquid maintains a favorable condition, and the final product is produced without the occurrence of bubbling.

As written above, this invention of the emulsified/dispersed liquid production system that makes use of the multistage pressure/temperature control device is useful for emulsified/dispersed liquids requiring a very strong shearing force, and can be used for homogenizers etc.

What is claimed is:

1. A system for manufacturing an emulsified/dispersed liquid by applying a shearing force to a liquid mixture containing a medium liquid and an emulsification/dispersion material of solid state or liquid state which is not soluble into the medium liquid so as to emulsify or disperse the emulsification/dispersion material into the medium liquid, the system comprising:

a liquid mixture supplying device for supplying the liquid mixture containing the medium liquid and the emulsification/dispersion material;

a liquid mixture pressurizing device for pressurizing the liquid mixture supplied by the liquid mixture supplying device and discharging the pressurized liquid mixture therefrom;

an emulsification/dispersion device adapted to receive the pressurized liquid mixture discharged by the liquid mixture pressurizing device and generate a jet flow of the liquid mixture by transforming pressure energy of the liquid mixture to kinetic energy so as to emulsify/disperse the emulsification/dispersion material in the liquid mixture into the medium liquid in the liquid mixture by means of the shearing force generated by the jet flow to produce the emulsified/dispersed liquid and discharge the emulsified/dispersed liquid therefrom; and a multistage pressure/temperature control device adapted to receive the emulsified/dispersed liquid discharged by the emulsification/dispersion device and control temperature of the emulsified/dispersed liquid while lowering the pressure of the emulsified/dispersed liquid, and simultaneously to apply a backpressure to the emulsified/dispersed liquid in the emulsification/dispersion device, wherein the multistage pressure/temperature control device comprises first to third controllers which are arranged in series from the upstream side to the downstream side with respect to a direction of a flow of the emulsified/dispersed liquid, each of the first to third controllers having a shell through which a heat transfer medium passes and a heat transfer tube arranged in the shell, through which the emulsified/dispersed liquid passes, the heat transfer tubes of the first to third controllers are connected to one another in series, and wherein;

the first to third controllers have inner diameters, total lengths, and general shapes of the heat transfer tubes which are designed on a basis of a flow rate and viscosity of the emulsified/dispersed liquid in the heat transfer tubes so as to satisfy a relationship of $\Delta P1>\Delta P3>\Delta P2$, wherein $\Delta P1$, $\Delta P2$ and $\Delta P3$ are amounts of pressure drops in the heat transfer tubes of the first to third controllers, respectively.

2. The system according to claim 1, wherein the inner diameters, total lengths and general shapes of the heat transfer tubes of the first to third controllers are designed in such a manner that the emulsified/dispersed liquid flows in a laminar state within the heat transfer tubes.

3. The system according to claim 1, wherein the inner diameters, total lengths and general shapes of the heat transfer tubes of the first to third controllers are designed in such a manner that the emulsified/dispersed liquid flows in a turbulent state within the heat transfer tubes.

4. The system according to claim 1, further comprising a heat exchanger for heating or cooling the liquid mixture, which is arranged between the liquid mixture supplying device and the liquid mixture pressurizing device with respect to the direction of the flow of the emulsified/dispersed liquid.

5. The system according to claim 4, wherein the liquid mixture supplying device comprises a liquid mixture pump for pressurizing and feeding the liquid mixture to the liquid mixture pressurizing device through the heat exchanger.

6. The system according to claim 1, wherein the emulsification/dispersion device comprises first to third pore components each of which includes a pore having a small inner diameter, the first to third pore components being arranged in series from the upstream side to the downstream side with respect to the direction of the flow of the emulsified/dispersed liquid in such a manner that the pores of the first to third pore components are connected to one another in series, and wherein the inner diameters of the pores of the first to third pre components are designed so as to satisfy the relationship of $d_2>d_1>d_3$, wherein $d_1$, $d_2$ and $d_3$ are inner diameters of the pores of the first to third pore components.

7. The system according to claim 6, wherein the emulsification/dispersion device is composed of first and second emulsification/dispersion devices which are connected to each other in series.

8. The system according to claim 7, further comprising a first agent feeder arranged at the downstream side of the first emulsification/dispersion device, for adding a first additive agent to the emulsified/dispersed liquid, and a second agent feeder arranged at the downstream side of the second emulsification/dispersion device, for adding a second additive agent to the emulsified/dispersed liquid.

9. The system according to claim 1, wherein the medium liquid is water.

* * * * *